US011969098B1

(12) United States Patent
Shi

(10) Patent No.: US 11,969,098 B1
(45) Date of Patent: Apr. 30, 2024

(54) INFLATABLE BED

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Guangdong (CN)

( * ) Notice: Subject to any disclaimer, the term of this patent is extended or adjusted under 35 U.S.C. 154(b) by 0 days.

(21) Appl. No.: 18/237,008

(22) Filed: Aug. 23, 2023

(30) Foreign Application Priority Data

Aug. 10, 2023 (CN) ..... 202322159834.4

(51) Int. Cl.
*A47C 27/08* (2006.01)
*A47C 27/10* (2006.01)

(52) U.S. Cl.
CPC ..... *A47C 27/084* (2013.01); *A47C 27/10* (2013.01)

(58) Field of Classification Search
CPC ..... A47C 27/08; A47C 27/081; A47C 27/082; A47C 27/083; A47C 27/084; A47C 27/088; A47C 27/10
See application file for complete search history.

(56) References Cited

U.S. PATENT DOCUMENTS 7,089,618 B1 * 8/2006 Metzger ..... A47C 27/087 5/709
11,641,948 B2 * 5/2023 Huang ..... A47C 27/081 5/706
2006/0065322 A1 * 3/2006 Wu ..... F04D 29/503 141/67
2006/0265810 A1 * 11/2006 Wu ..... A47C 27/081 5/712
2007/0283499 A1 * 12/2007 Lin ..... A47C 27/081 5/713
2015/0201760 A1 * 7/2015 Lin ..... A47C 27/087 5/710
2015/0335164 A1 * 11/2015 Liu ..... F24F 1/022 156/278
2016/0242557 A1 * 8/2016 Scarleski ..... A47C 19/025
2017/0196368 A1 * 7/2017 Liu ..... A47C 27/16
2020/0100598 A1 * 4/2020 Huang ..... A47C 27/087
2020/0187668 A1 * 6/2020 Ocegueda Gallaga ..... A47C 27/087
2021/0127849 A1 * 5/2021 Li ..... A47C 27/12
2021/0169232 A1 * 6/2021 Hou ..... A47C 27/087
2021/0259434 A1 * 8/2021 Wang ..... A47C 27/10

* cited by examiner

*Primary Examiner* — Justin C Mikowski
*Assistant Examiner* — George Sun
(74) *Attorney, Agent, or Firm* — Cooper Legal Group, LLC

(57) ABSTRACT

The present application relates to the technical field of inflatable bed, and in particular an inflatable bed including a bed body, wherein the bed body is hollow, the bed body includes a top sheet, a peripheral sheet, a bottom sheet, and a tension strap, the top sheet and the bottom sheet cover the peripheral sheet from a top side and a bottom side, respectively, an internal support assembly is provided inside the bed body, the internal support assembly includes an internal support structure and a breathable mesh, the bed body is separated into a main chamber and an auxiliary chamber surrounding the main chamber by the internal support structure, and the breathable mesh is mounted on a sidewall of the internal support structure, the main chamber is in communication with the auxiliary chamber through the breathable mesh.

4 Claims, 5 Drawing Sheets

A

B

INFLATABLE BED

CROSS-REFERENCE TO RELATED APPLICATION

This application claims the priority to Chinese patent application No. 202322159834.4, filed on Aug. 10, 2023. The entirety of Chinese patent application No. 202322159834.4 is hereby incorporated by reference herein and made a part of this specification.

FIELD OF THE INVENTION

The present application relates to the field of inflatable bed, in particular to an inflatable bed.

DESCRIPTION OF RELATED ART

At present, a multi-chamber inflatable bed, such as a three-chamber inflatable bed, includes a peripheral sheet, a top sheet, a bottom sheet, an upper inclined belt, and a lower inclined belt. The top sheet and the bottom sheet are both thermally sealed with the peripheral sheet, the upper inclined belt is thermally welded with the top sheet and the peripheral sheet, and the lower inclined belt is thermally welded with the bottom sheet and the peripheral sheet, so a three chamber structure is formed. In order to connect a plurality of air chambers, vent holes are formed through both the upper inclined belt and the lower inclined belt.

However, vent holes needs to be fabricated in the upper or lower inclined belts in existing inflatable beds, and the process is cumbersome. Moreover, the peripheral sheet, upper inclined belt, and lower inclined belt are all made of PVC (Polyvinyl Chloride) material, but the PVC material has a certain extensibility and ductility, so the peripheral sheet is prone to swelling and bulging during use, resulting in poor stability and poor comfort.

BRIEF SUMMARY OF THE INVENTION

In order to improve the stability of the overall structure of an inflatable bed, the present application provides an inflatable bed.

The inflatable bed provided in the present application adopts the following technical solution:

an inflatable bed, including a bed body, wherein the bed body is hollow, the bed body includes a top sheet, a peripheral sheet, a bottom sheet, and a tension strap, the top sheet and the bottom sheet cover the peripheral sheet from a top side and a bottom side, respectively, an internal support assembly is provided inside the bed body, the internal support assembly includes an internal support structure and a breathable mesh, the internal support structure is fixed to the top sheet at the top of internal support structure, the internal support structure is fixed to the peripheral sheet of the bed body, the bed body is separated into a main chamber and an auxiliary chamber surrounding the main chamber by the internal support structure, and the breathable mesh is mounted on a sidewall of the internal support structure, the main chamber is in communication with the auxiliary chamber through the breathable mesh.

In the above technical solution, the auxiliary chamber can enhance the strength of the periphery of the bed. When the bed is in use, users or items on the bed are not prone to sliding off the bed due to the collapse of the periphery, making it comfortable and safe to use. At the same time, due to the stronger deformation ability of the internal support structure than the breathable mesh, when the internal support structure is connected to the bed body, the internal support structure is bonded with the bed body well, a high strength at the connection position is achieved, and the connection is not prone to cracks or direct separation, so that a long service life is achieved. Moreover, the breathable mesh is mounted on the internal support structure, and the mesh holes of the breathable mesh achieve the interconnection between the main chamber and the auxiliary chamber. The breathable mesh has a relatively weak deformation ability, and plays a role in enhancing the strength of the internal support structure. The breathable mesh can provide stable tension, so as to effectively suppressing the extensibility and ductility of the internal support structure and the bed body. The internal support structure is not easily deformed by tension, so that the bed body is not prone to swelling and bulging due to factors such as tensile failure or excessive air pressure. The bed body has high stability, long service life, and high comfort in use.

In some embodiments, the internal support structure includes a plurality of enclosing sheets.

In the above technical solution, as the internal support structure includes a plurality of enclosing sheets, it is possible to synchronously assemble breathable meshes on a plurality of enclosing sheets, and then the enclosing sheets loaded with breathable meshes are combined together to form the internal support structure, which has higher assembling efficiency and is more convenient for assembling.

In some embodiments, an assembling through hole is formed in the enclosing sheet, and a shape and size of the assembling through hole are matched with a shape and size of the breathable mesh.

In the above technical solution, during the processing of the enclosing sheet, assembling through holes are reserved to facilitate the mounting of the breathable mesh.

In some embodiments, a bending part is arranged between two adjacent enclosing sheets, and the bending part has a trapezoidal cross-section.

In the above technical solution, the connection strength between two adjacent enclosing sheets can be strengthened by the bending part. At the same time, due to the trapezoidal cross-section of the bending part, the bending part has high stability, strong support performance, and significant compressive capacity.

In some embodiments, four corners of the internal support structure are provided with four reinforcing airbags, respectively, and the four reinforcing airbags are configured to support four corners of the bed body, respectively.

In the above technical solution, due to small air volume at the four corners of the bed body, the four corners of the bed body are likely to collapse when the user sits at them. Therefore, by arranging four reinforcing airbags at the four corners of the bed body, the structural strength of the weak parts of the bed body can be improved.

In some embodiments, a gas port is formed in a sidewall of the internal support structure, the gas port is in communication with the reinforcing airbag, and a one-way gas nozzle is installed at the gas port.

In the above technical solution, due to the small volume of the reinforcing airbag, gas is only sent into the reinforcing airbag through the one-way gas nozzle after the main chamber and the auxiliary chamber have completed inflation. The one-way gas nozzle can reduce the amount of gas in the reinforcing airbag that easily flows into the main cavity due to compression of the reinforcing airbag, so that the structural strength of the reinforcing airbag is ensured.

In some embodiments, a positioning slot is formed in an inner sidewall of the bed body, and the reinforcing airbag abuts against the positioning slot.

In the above technical solution, the reinforcing airbag abuts against the positioning slot, thereby limiting the horizontal moving of the reinforcing airbag and further improving the stability of the reinforcing airbag.

In some embodiments, an upper surface of the bed body is provided with flocking embossing.

In the above technical solution, by arranging the flocking embossing on the surface of the bed body, the water absorption, waterproof performance, and scalability of the bed body can be indirectly improved.

In some embodiments, a built-in gas pump is mounted in a sidewall of the bed body, the built-in gas pump includes a mounting plate and a pump body, wherein the mounting plate is mounted at the inner side of the peripheral sheet, the pump body is arranged in the main chamber, and the mounting plate is provided with a support rod configured to support the top sheet and the bottom sheet.

In the above technical solution, the mounting plate is configured to carry a pump body, and the support rod is configured to support the area where the built-in gas pump is located, reducing the occurrence of damage caused by excessive pressure applied to the built-in gas pump by users when using the bed body.

In some embodiments, an end of the support rod is fixed with an arc-shaped plate, and the arc-shaped plate abuts against the top sheet and the bottom sheet of the bed body.

In the above technical solution, the arc-shaped plate can disperse the pressure evenly and has a good compressive strength.

In summary, the present application can achieve at least one of the following beneficial technical effects:

1. The bed body is not prone to swelling and bulging due to factors such as tensile failure or excessive air pressure. The bed body has high stability, long service life, and high comfort in use;
2. By arranging four reinforcing airbags at the four corners of the bed body, the structural strength of the weak parts of the bed body can be improved;
3. By arranging the flocking embossing on the surface of the bed body, the water absorption, waterproof performance, and scalability of the bed body can be indirectly improved.

DETAILED DESCRIPTION

The present application is described in detail below in combination with FIGS. 1-6.

Embodiment 1

Figure 1:
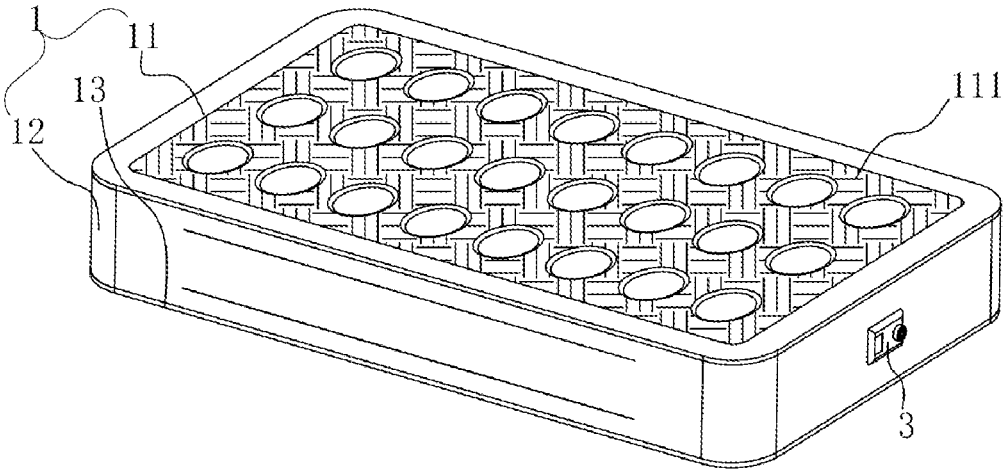
FIG. 1 is a schematic diagram of the overall structure of Embodiment 1 of the present application.
Figure 2:
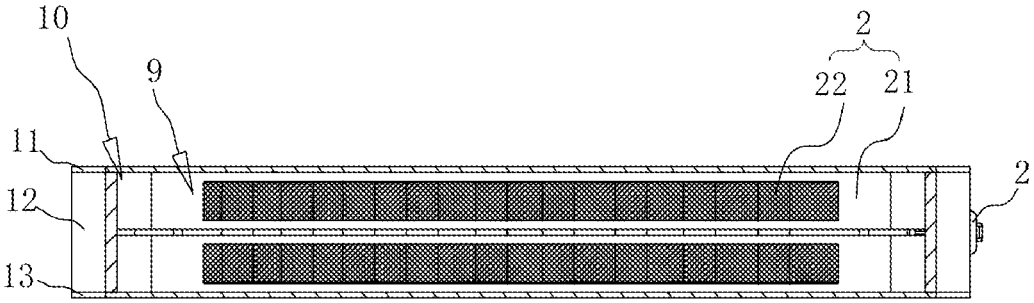
FIG. 2 is a partial sectional view of Embodiment 1 of the present application.

This embodiment of the present application discloses an inflatable bed. Referring to FIGS. 1 and 2, the inflatable bed includes a bed body 1. The bed body 1 includes a top sheet 11, a peripheral sheet 12, a bottom sheet 13, and a tension strap 4 (referring to FIG. 3). The top sheet 11 and the bottom sheet 13 are both arranged in a sheet shape, and the peripheral sheet 12 is arranged in an open manner. The top sheet 11 and the bottom sheet 13 cover the peripheral sheet 12 from a top side and a bottom side, respectively, and are fixed by hot melting with the peripheral sheet 12 to form a cuboid structure. At the same time, a plurality of tension straps 4 are provided, one end of the tension strap 4 is fixed to the top sheet 11, and the other end of the tension strap 4 is fixed to the bottom sheet 13. The plurality of tension straps 4 cooperate to stabilize the bed body 1. In this embodiment, the bed body 1 can be made of PVC material, which has a certain deformation ability, and the shape of the bed body 1 can be adjusted adaptively during use, making it less prone to damage. In this embodiment, the tension straps 4 are arranged in a cubic column structure, connecting the top sheet 11 and the bottom sheet 13, so that the top sheet 11 gives a concave-convex comfortable sensation to the human body, and the bottom sheet 13 can be stable on the ground. In other embodiments, the tension straps 4 can also be arranged in a spiral rope or flat wire shape. Moreover, the top surface of the top sheet 11 is provided with flocking embossing 111, which can indirectly improve the water absorption, waterproof performance, and scalability of the bed body 1.

On the other hand, an internal support assembly 2 is provided inside the bed body 1, and there are two sets of internal support assemblies 2. The two sets of internal support assemblies 2 are symmetrically arranged in the bed body 1. Specifically, the internal support assembly 2 includes an internal support structure 21 and a breathable mesh 22. The internal support structure 21 is fixed to the top sheet 11 of the bed body 1 at the top of the internal support structure 21, the internal support structure 21 is fixed to peripheral sheet 12 of the bed body 1, means that, the internal support structure 21 is fixed to the top sheet 11 and the peripheral sheet 12 of the bed body 1. And the bed body 1 is separated into a main chamber and an auxiliary chamber surrounding the main chamber by the internal support structure 21.

Specifically, in this embodiment, the internal support structure 21 is a PVC membrane or TPU membrane, which can provide a certain ductility for the internal support structure 21, and can adaptively adjust its shape during use, making it less prone to damage. At the same time, the internal support structure 21 has a good bonding effect when welded with the bed body 1, with a high welding firmness, less cracking of the weld seam, and long service life.

Figure 3:
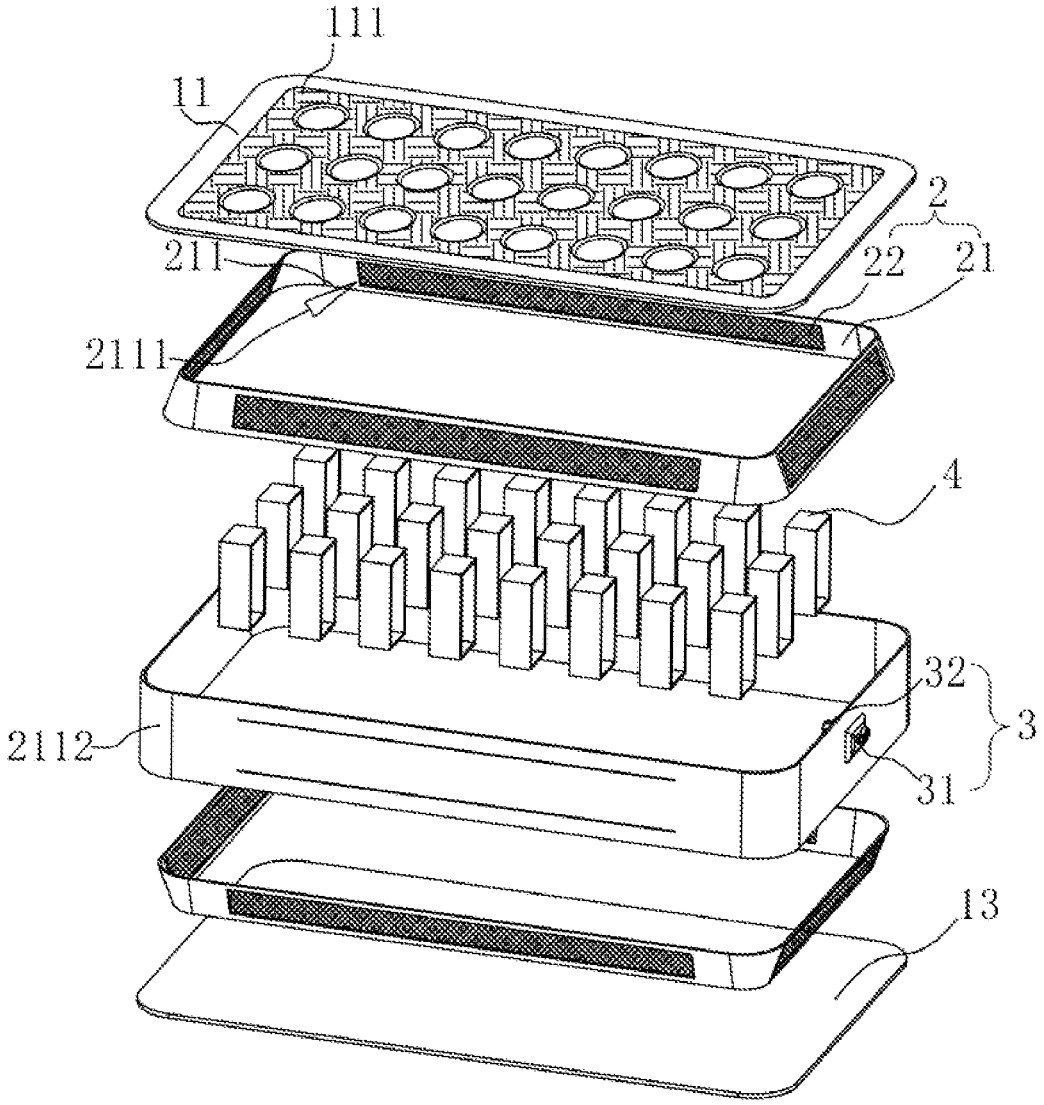
FIG. 3 is an assembling schematic diagram of Embodiment 1 of the present application.

Referring to FIGS. 2 and 3, further, the internal support structure 21 includes four enclosing sheets 211. A bending part 2112 is formed at the connection between two adjacent enclosing sheets 211. Therefore, the internal support structure 21 has four bending parts 2112, and the four bending parts 2112 are arranged at intervals in the circumferential direction of the internal support structure 21. A bending part 2112 is formed between two adjacent enclosing sheets 211, such that the bending part 2112 of the internal support structure is shown to be an isosceles trapezoidal shape when the bending part 2112 is unfolded, thereby a high stability, a strong support performance, and significant compression resistance are achieved.

On the other hand, a rectangular shaped assembling through hole 2111 is formed in each enclosing sheet 211, and a bending part 2112 is arranged between adjacent assembling through holes 2111. Each enclosing sheet 211 is equipped with a rectangular shaped breathable mesh 22, and each breathable mesh 22 covers the corresponding assembling through hole 2111, allowing the main chamber and auxiliary chamber to be connected through the mesh holes on the breathable mesh 22. It should be understood that the breathable mesh 22 can be fixed to the internal support structure 21 through heat sealing welding, and the breathable mesh 22 is firmly bonded with the internal support structure 21. In this embodiment, the internal support structure 21 can be made by welding four independent enclosing sheets 211. That is, four independent enclosing sheets 211 are processed first, then the four enclosing sheets 211 are spliced, and hot welded can be carried out at the splicing points.

In addition, when assembling the breathable mesh 22 and the internal support structure 21, the breathable mesh 22 can be thermally welded to the internal support structure 21 first. Then, the internal support structure 21 can be cut at corresponding position to form an assembling through hole 2111 according to the outer contour shape of the breathable mesh 22. The mesh hole on the breathable mesh 22 is located in the area enclosed by the assembling through hole 2111. By using this method to assemble the breathable mesh 22 and the internal support structure 21, due to the integral structure of the internal support structure 21, there is no assembling through hole 2111 on the internal support structure 21 before thermal fixation, so the internal support structure 21 has high structural strength and is not easy to deform. The connection firmness between the breathable mesh 22 and the internal support structure 21 is improved because the combination is tight. The assembling through hole 2111 is formed after the breathable mesh 22 is fixed to the internal support structure 21, so the misalignment between the breathable mesh 22 and the assembling through hole 2111 not easily appears, and a high matching quality is obtained.

In this embodiment, the breathable mesh 22 is made of fiber material, that is, the breathable mesh 22 is a fiber mesh. For example, the breathable mesh 22 may be a chemical fiber mesh, polyester mesh, etc.

In addition, a built-in gas pump 3 is mounted in the sidewall of the bed body 1, that is, in the peripheral sheet 12 of the bed body 1, and the built-in gas pump 3 is configured for inflation. Specifically, the built-in gas pump 3 includes a mounting plate 31 and a pump body 32. The mounting plate 31 is mounted in the sidewall of the bed body 1, that is, mounted at the inner side of the peripheral sheet 12, and the pump body 32 is arranged in the main chamber.

The implementation principle of an inflatable bed in this embodiment of the present application is as follows: when in use, a sufficient amount of gas can be filled into the main chamber using the pump body 32, the gas in the main chamber can directly enter the auxiliary chamber through the mesh holes in the breathable mesh 22, so that the air pressure in the main chamber and the auxiliary chamber is consistent. As the auxiliary chamber is arranged around the main chamber, the auxiliary chamber is located at the periphery of the bed body 1, which can enhance the strength of the periphery of the bed body 1. The bed body 1 is not prone to significant collapse at the periphery when in use. Users or items on the bed body 1 are not likely to slide off the bed body 1 due to collapse of the periphery, making it comfortable and safe to use. After inflation is completed, the internal support structure 21 cooperates with the breathable mesh 22 to provide tension, so as to keep the shape of the bed body 1 fixed. It should be understood that due to the stronger deformation ability of the internal support structure 21 than the breathable mesh 22, when the internal support structure 21 is connected to the bed body 1, the internal support structure 21 is bonded with the bed body 1 well, a high strength at the connection position is achieved, and the connection is not prone to cracks or direct separation, so that a long service life is achieved. Moreover, the breathable mesh 22 is mounted on the internal support structure 21, and the mesh holes of the breathable mesh 22 achieve the interconnection between the main chamber and the auxiliary chamber. The breathable mesh 22 has a relatively weak deformation ability, and plays a role in enhancing the strength of the internal support structure 21. The breathable mesh 22 can provide stable tension, so as to effectively suppressing the extensibility and ductility of the internal support structure 21 and the bed body 1. The internal support structure 21 is not easily deformed by tension, so that the bed body 1 is not prone to swelling and bulging due to factors such as tensile failure or excessive air pressure. The bed body 1 has high stability, long service life, and high comfort in use.

Embodiment 2

Figure 4:
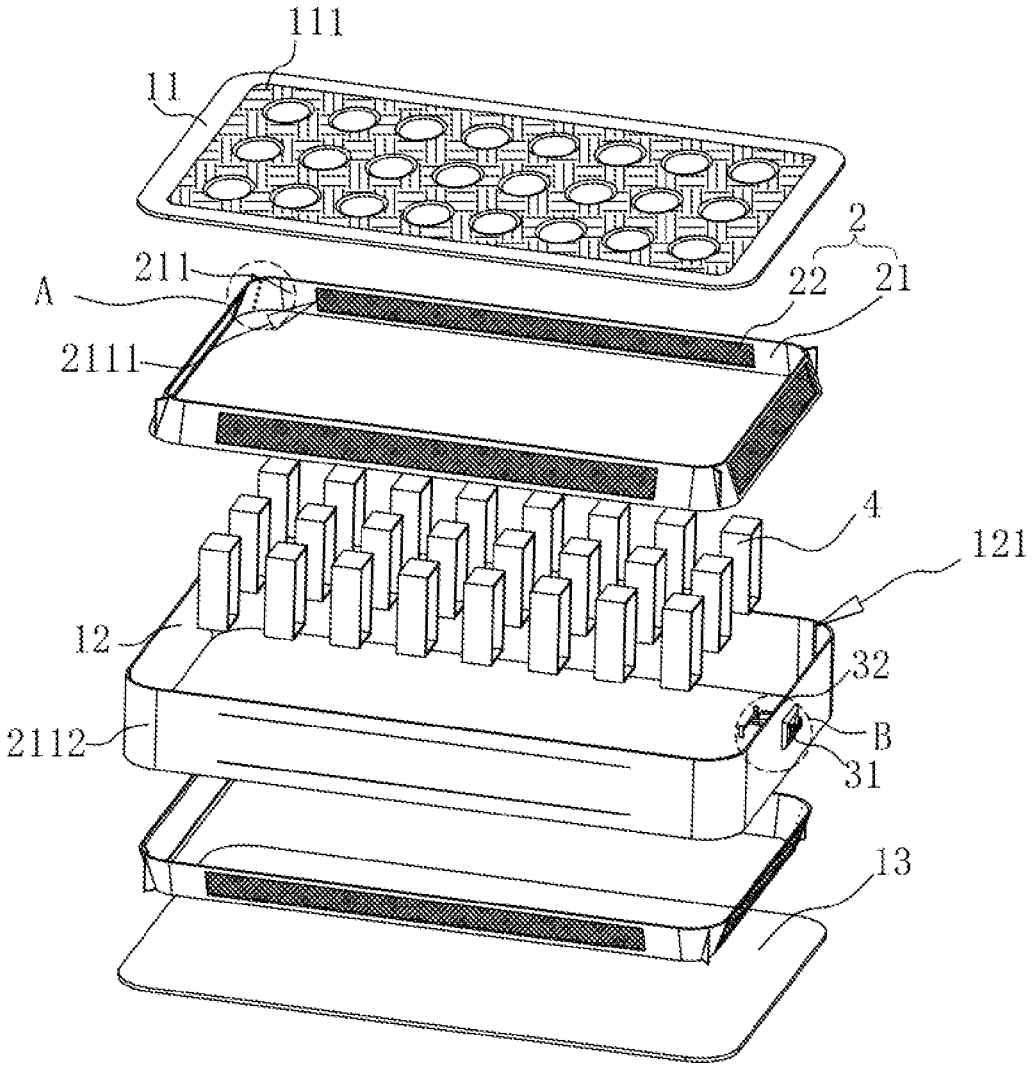
FIG. 4 is an assembling schematic diagram of Embodiment 2 of the present application.
Figure 5:
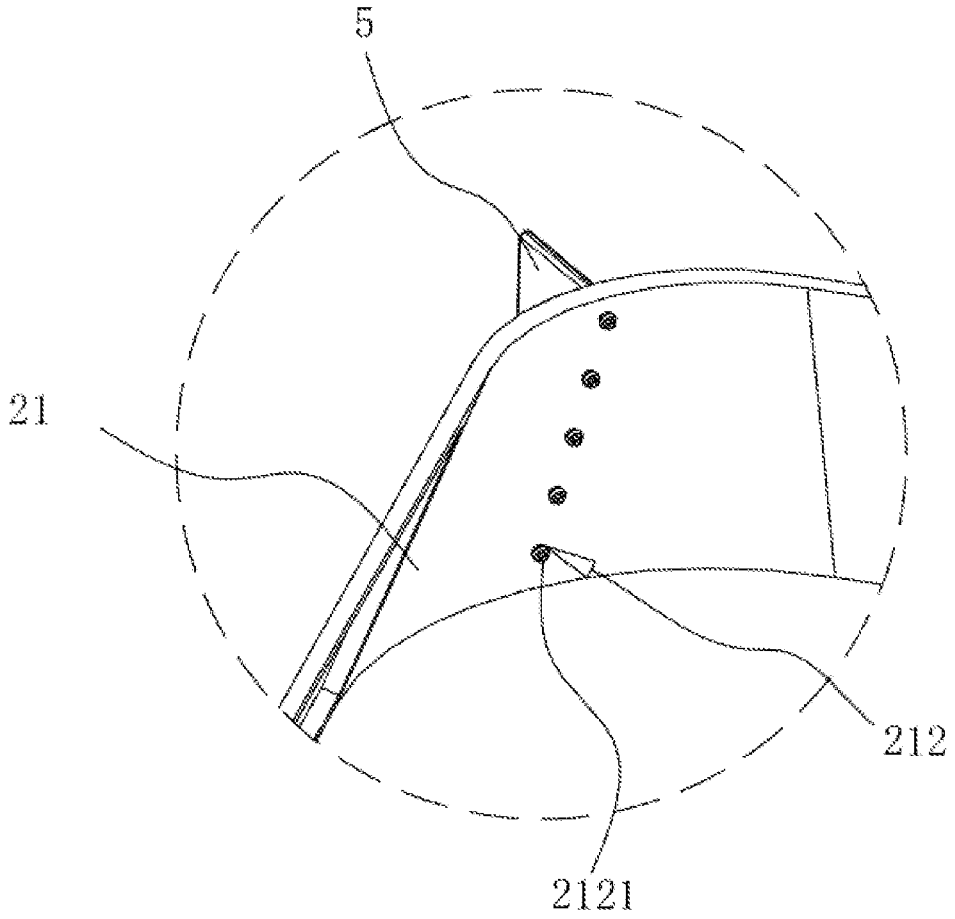
FIG. 5 is an enlarged schematic diagram of Part A in FIG. 3.

Referring to FIGS. 4 and 5, the difference between this embodiment and Embodiment 1 is that the four corners of the internal support structure 21 are provided with four reinforcing airbags 5, respectively, and the four reinforcing airbags 5 are configured to support the four corners of the bed body 1, respectively. In this embodiment, the reinforcing airbag 5 is also made of PVC membrane or TPU membrane. The reinforcing airbag 5 is a membrane like structure with an opening at one side, and is fixed with the internal support structure 21 through heat sealing welding.

Correspondingly, a gas port 212 is formed in a sidewall of the internal support structure 21, in particular, at the enclosing sheets 211, the gas port 212 is in communication with the reinforcing airbag 5, and a one-way gas nozzle 2121 is installed at the gas port 212. Due to the small volume of the reinforcing airbag 5, gas is only sent into the reinforcing airbag 5 through the one-way gas nozzle 2121 after the main chamber and the auxiliary chamber have completed inflation. The one-way gas nozzle 2121 can reduce the amount of gas in the reinforcing airbag 5 that easily flows into the main cavity due to compression of the reinforcing airbag 5, so that the structural strength of the reinforcing airbag 5 is ensured.

In addition, as the usage time increases, a small amount of gas in the reinforcing airbag 5 may also flow out from the one-way gas nozzle 2121. Therefore, the gas in the reinforcing airbag 5 can be supplemented during the inflation of the main chamber and auxiliary chamber.

Further, the reinforcing airbag 5 has a triangular cross-sectional shape, which has a certain stability, further improving the structural stability of the reinforcing airbag 5. In addition, a positioning slot 121 is formed in an inner sidewall of the peripheral sheet 12 in a vertical direction. The reinforcing airbag 5 abuts against the positioning slot 121, thereby limiting the horizontal moving of the reinforcing airbag 5 and further improving the stability of the reinforcing airbag 5. When the inflatable bed is inflated for a plurality of times, the reinforcing airbag 5 is inserted into the positioning slot 121 to play a positioning role. Moreover, when the inflatable bed is stored, the reinforcing airbag 5 can retain the original triangular structure, which is convenient for users to quickly identify the positions of the four corners of the inflatable bed and store it quickly. In addition, after the inflatable bed is stored, the reinforcing airbag 5 can play an internal support role, provide a certain shaping ability for the overall structure of the folded inflatable bed, and reduce the occurrence that users need to support the soft folded inflatable bed when taking it, further improving the convenience for using the inflatable bed.

Figure 6:
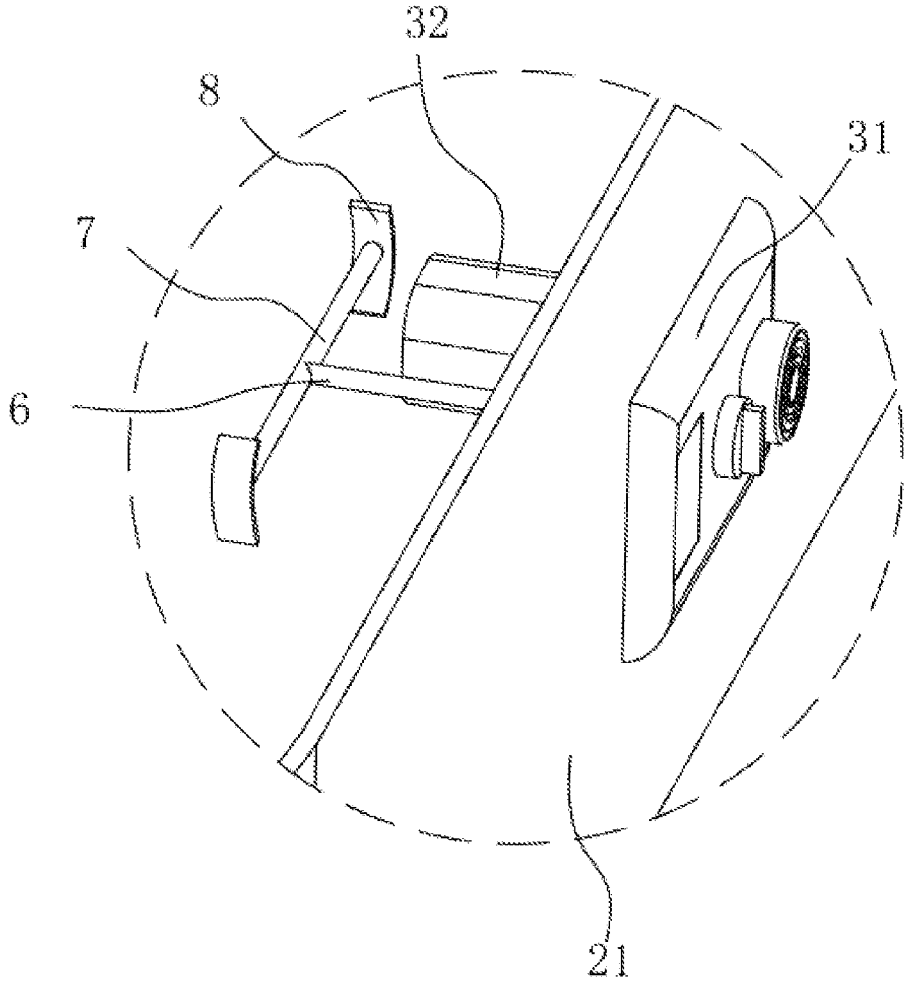
FIG. 6 is an enlarged schematic diagram of Part B in FIG. 3.

Referring to FIGS. 4 and 6, a connecting rod 6 is rotatably connected on a sidewall of the mounting plate 31 and is supported by the mounting plate 31. The connecting rod 6 is arranged along a length direction of the bed body 1. One end of the connecting rod 6 penetrates the mounting plate 31, and a self-locking knob is provided on the mounting plate 31. The connecting rod 6 is coaxially fixed with the self-locking knob. At the same time, the end of the connecting rod 6 is vertically fixed with a support rod 7 configured to support the upper and lower inner walls of the bed body 1, that is to support the top sheet 11 and the bottom sheet 13. Specifically, an end of the support rod 7 is fixed with an arc-shaped plate 8, and the sidewall of the arc-shaped plate 8 abuts against the inner wall of the bed body 1, that is the top sheet 11 and the bottom sheet 13.

The mounting plate 31 is configured to carry the pump body 32, and the support rod 7 cooperates with the arc-shaped plate 8 to support the area where the built-in gas pump 3 is located. The arc-shaped plate 8 can disperse the pressure evenly and has good compression resistance, reducing the occurrence of damage caused by excessive pressure applied to the built-in gas pump 3 by users when using the bed body 1. At the same time, the angle of the support rod 7 can be changed by rotating the connecting rod 6, which can reduce the relative space occupied by the support rod 7 when the inflatable bed is stored.

The implementation principle of the present application is generally the same as that of Embodiment 1, and will not be described in detail.

The above are all preferred embodiments of the present application and do not intend to limit the protection scope of the present application. Therefore, any equivalent changes made based on the structure, shape, and principle of the present application should fall within the protection scope of the present application.

LISTING OF REFERENCE SIGNS

1. bed body;
11. top sheet;
111. flocking embossing;
12. peripheral sheet;
121. positioning slot;
13. bottom sheet;
2. internal support assembly;
21. internal support structure;
211. enclosing sheet;
2111. assembling through hole;
2112. bending part;
212. gas port;
2121. one-way gas nozzle;
22. breathable mesh;
3. built-in gas pump;
31. mounting plate;
32. pump body;
4. tension strap;
5. reinforcing airbag;
6. connecting rod;
7. support rod;
8. arc-shaped plate;
9. main chamber;
10. auxiliary chamber.

What is claimed is:

1. An inflatable bed, comprising a bed body, wherein the bed body is hollow, the bed body comprises a top sheet, a peripheral sheet, a bottom sheet, and a tension strap, the top sheet and the bottom sheet cover the peripheral sheet from a top side and a bottom side, respectively, an internal support assembly is provided inside the bed body, the internal support assembly comprises an internal support structure and a breathable mesh, the internal support structure is fixed to the top sheet at a top of the internal support structure, the internal support structure is fixed to the peripheral sheet of the bed body, the bed body is separated into a main chamber and an auxiliary chamber surrounding the main chamber by the internal support structure, the breathable mesh is mounted on a sidewall of the internal support structure, the main chamber is in communication with the auxiliary chamber through the breathable mesh, the internal support structure comprises a plurality of enclosing sheets, an assembling through hole is formed in each of the plurality of enclosing sheets, a shape and size of the assembling through hole are matched with a shape and size of the breathable mesh, four corners of the internal support structure are provided with four reinforcing airbags, respectively, and the four reinforcing airbags are configured to support four corners of the bed body, respectively, the four reinforcing airbags have a triangular cross-sectional shape, an upper surface of the bed body is provided with flocking embossing, a mounting plate is mounted in a sidewall of the bed body, a connecting rod is rotatably connected on a sidewall of the mounting plate and is supported by the mounting plate, and an end of the connecting rod is vertically fixed with a support rod configured to support an upper inner wall and a lower inner wall of the bed body to support the top sheet and the bottom sheet.

2. The inflatable bed according to claim 1, wherein a bending part is arranged between two adjacent enclosing sheets of the plurality of enclosing sheets, and the bending part has a trapezoidal cross-section.

3. The inflatable bed according to claim 1, wherein a gas port is formed in the sidewall of the internal support structure, the gas port is in communication with at least one of the four reinforcing airbags, and a one-way gas nozzle is installed at the gas port.

4. The inflatable bed according to claim 1, wherein a positioning slot is formed in an inner sidewall of the bed body, and the four reinforcing airbags abut against the positioning slot.

* * * * *